United States Patent [19]

Rielly

[11] 4,043,450

[45] Aug. 23, 1977

[54] DISPLAY BOX CONSTRUCTION

[75] Inventor: Owen G. Rielly, Lincoln, R.I.

[73] Assignee: Frost Packaging Company, Pawtucket, R.I.

[21] Appl. No.: 762,464

[22] Filed: Jan. 24, 1977

[51] Int. Cl.[2] ..... B65D 5/50; B65D 1/34

[52] U.S. Cl. ..... 206/45.14; 206/45.19; 206/45.2; 206/566

[58] Field of Search ..... 206/45.14, 45.11, 45.13, 206/75, 806, 45.19, 75, 76, 45.2

[56] References Cited

U.S. PATENT DOCUMENTS 3,930,576 1/1976 Stephens ..... 206/45.14 X 4,011,942 3/1977 Crosslen ..... 206/45.14

*Primary Examiner*—George T. Hall

*Attorney, Agent, or Firm*—Salter & Michaelson

[57] ABSTRACT

A box for the display of jewelry and the like including cover and base sections generally hingedly connected to each other and adapted for disposition in closed and open positions wherein the cover section of the box includes means on the top surface thereof for receiving an insert normally positionable within the base section of the box and on which jewelry and the like is displayed, so that such jewelry may alternatively be displayed while the box is in a closed position thus reducing the vertical space requirements for such display.

10 Claims, 6 Drawing Figures

DISPLAY BOX CONSTRUCTION

BACKGROUND AND SUMMARY OF THE INVENTION

This invention relates to a display box construction adapted for the containment of jewelry and the like and especially to such box constructions which are normally made up of opposed box sections hingedly connected along a common line and adapted to receive an insert in the base section thereof for the mounting of jewelry items thereon. Boxes of this type must normally be maintained in an open position, i.e., with the top or cover section in generally upstanding or vertical disposition, when it is desired to visually display the contents thereof.

The base and cover sections of such boxes normally include a rim configured so as to define the geometric outline of the section and a closure portion forming either a bottom or top wall, dependent upon the use to which such section is ultimately placed, since it is common to utilize sections of identical construction for both the top and bottom box sections. Generally, the sidewalls are formed from thin metal rim stock appropriately bent and including opposed flanges for receiving and mounting the closure portion, and may further include interior reinforcements of cardboard stock and the like. Alternatively, the box sections may entirely be formed of metal or cardboard stock.

The insert normally associated with such boxes includes a generally planar surface adapted to receive and position jewelry and the like thereon, and a plurality of legs or downwardly extending sidewalls adapted to interfit with the base section of the box and in this way enable the box to function as a container for the jewelry items, as well as for the display thereof, as by the opening of the cover section to a generally upright, i.e. vertically disposed, attitude with respect to the base section. Often several or more jewelry items contained within such boxes are displayed simultaneously as in display cases having a plurality of horizontal shelves, one above the other. In such and other similar displays, it has been found that the conventional box construction of the above indicated type requires that the distance between the shelves be large enough to accomodate the height of the box cover section in its open generally vertically extending display mode. This limits the number of boxes that may be simultaneously displayed in open position and is accordingly undesirable if display space is limited. It would thus be desirable if the jewelry items adapted for containment in such boxes be displayed in such a manner that the space requirements necessary to accommodate the box section cover in its open position could be reduced or eliminated and yet still enable the box to function alternatively as both a container and a display device.

It is accordingly a primary object of the present invention to provide a box construction which although otherwise functioning as a conventional box, can alternatively function to display jewelry items normally contained therein within minimum vertical space requirements.

A further object of the present invention is the provision of a box construction having base and cover sections adapted to move between open display and closed containment positions wherein means which otherwise do not necessitate any changes in the box construction are provided so as to enable the jewelry items contained therein to be displayed while the box is in closed position, thus utilizing lesser height requirements than previously required.

A still further object of the present invention is the provision of a box construction having base and cover sections hingedly connected together and adapted to receive in the base section thereof an insert having a surface for the display of jewelry and the like and wherein means is provided on the top surface of the cover section to receive such insert so as to enable the display of such jewelry items in a closed box position.

An even further object of the present invention is to provide a box construction as set forth in the immediately preceding objective wherein the means for receiving the insert forms a decorative element of the box construction.

These and other objects of the present invention have been accomplished by the provision of a box including generally open face cover and base sections adapted for face-to-face disposition to each other in a closed position and hingedly connected to each other along a common line for spaced apart disposition in an open position, wherein means in the form of upstanding ridges, downwardly extending grooves or the like are provided in the top surface of the cover section so as to frictionally receive downwardly extending sidewall portions of an insert, including a generally planar surface adapted to receive jewelry items and the like, so that such items may be displayed on the top cover portion of the box while such box is in a closed position, thus enabling display of such jewelry items in far less room than was hitherto before required.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
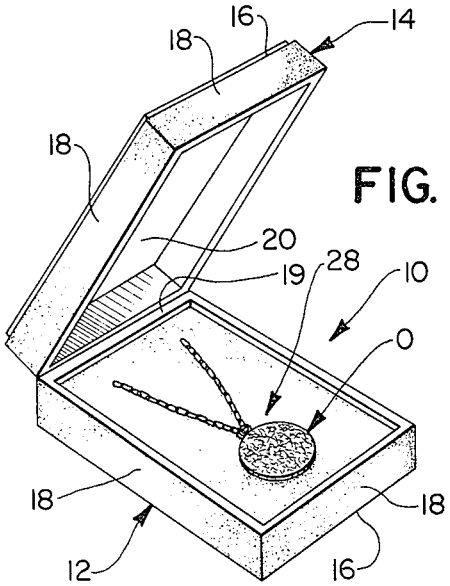
FIG. 1 is a perspective view of a box incorporating the features of the present invention in an open or conventional display attitude.

A box 10 having base and cover sections 12 and 14 respectively is shown in FIG. 1 of the drawing. Each such section includes a rim or sidewall 16 including separate sidewall panels 18 dependent on the particular geometric configuration of each of the sections. The sections 12, 14 are interconnected by conventional hinge means (not shown) along a common line 19 formed at the juncture of the two rearwardly disposed panels 18. In this manner, then, the sections are adapted for alternate open or closed disposition with regard to each other, the open disposition being shown in FIG. 1 of the drawing and the closed disposition illustrated in FIG. 2 thereof. Each of the sections of the box 10 is further provided with a closure in the form of a top wall 20, in the case of the cover section 14, and a bottom wall 22 in case of the base section 12. As with conventional box constructions, the closures 20, 22, as well as stiffening means such as the peripheral cardboard insert 244, may be interfitted and held between a pair of opposed flanges 26 inwardly extending from top and bottom peripheral portions of the rim 16.

The base section 12 is further adapted to receive an insert 28 including a generally planar surface 30 and a plurality of legs or sidewalls 32 downwardly extending from the peripheral edges 34 and in turn terminating in terminal edges 36. The insert is generally formed of cardboard or paperboard material provided with an outer decorative surface, such as flocking or a covering of fabric and the like, and the sidewalls or flanges 32 formed as by the bending of portions of such insert along score lines (not shown) and contiguous with the peripheral portions 34 of the planar surface 30. Jewelry items such as the ornament "O" are mounted on the top planar surface 30 as through spaced openings 40 for the receipt of chain portions 42 or other appropriate fastening means such as staples, grooves, adhesive connections etc.

Figure 2:
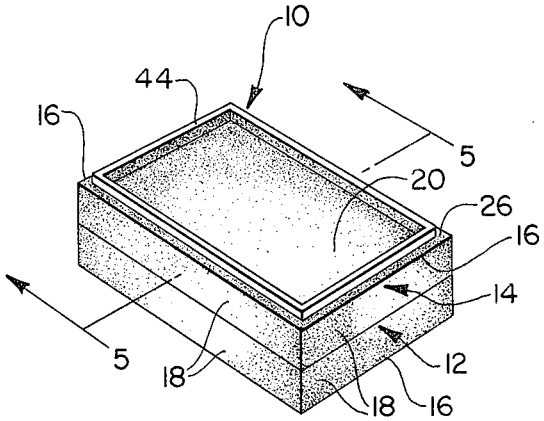
FIG. 2 is a perspective view of a box in a closed normal containment attitude depicting more clearly features of the present invention.
Figure 3:
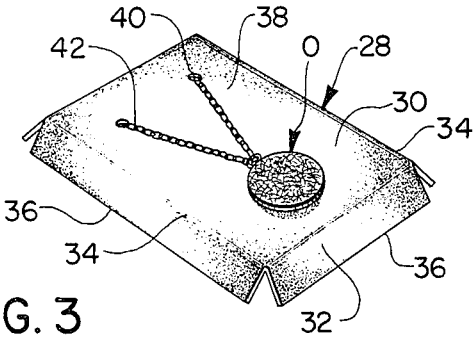
FIG. 3 is a perspective view of a conventional insert adapted to receive and display jewelry items and the like and in turn adapted for positioning within the base portion of a jewelry display box.
Figure 4:
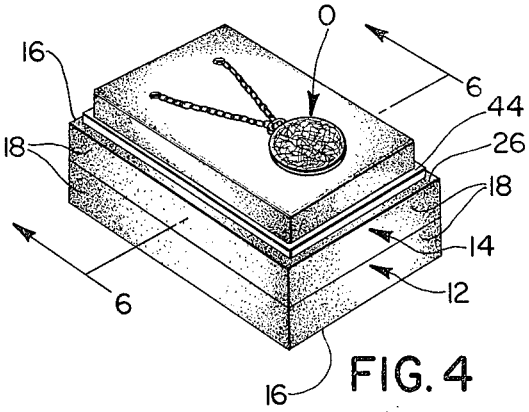
FIG. 4 is a perspective view similar to FIG. 2 of the drawings but showing the display insert positioned upon the cover of the box construction when such is in a closed attitude.
Figure 5:
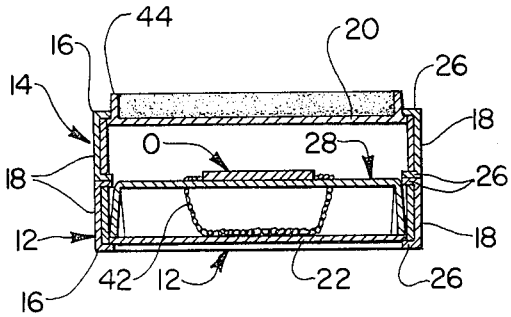
FIG. 5 is a cross-sectional view taken along the line 5—5 of FIG. 2 depicting the box construction functioning as a container.
Figure 6:
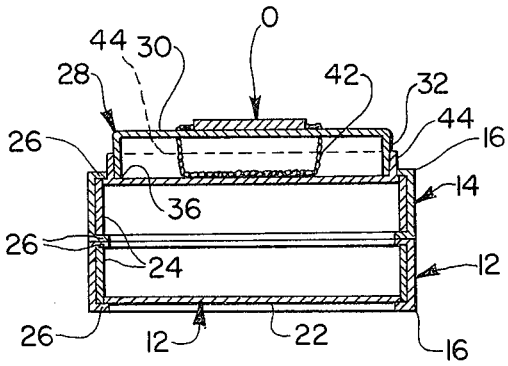
FIG. 6 is a cross-sectional view similar to FIG. 5 but taken along the line 6—6 of FIG. 4 and showing the box in a display mode wherein the insert as shown in FIG. 3 has been positioned upon the top cover portion thereof.

Thus, as best shown in FIG. 5 of the drawing, the insert 28 with the ornament O in place thereon is adapted to be frictionally received within the base section 12 as by being inserted therein until the terminal sidewall edges 36 engage the bottom wall 22. Accordingly, it should be clear that the box 10, in its normal closed position, as depicted in FIGS. 2 and 5, may be conventionally used as a container for the insert 28 and its associate ornament O and as a display device therefor in its open position as depicted in FIG. 1 of the drawing. As previously explained, however, such conventional open display mode requires considerable vertical spacing between shelves when such boxes are displayed on the shelves of display cases, as is commonly done. Thus, in accordance with the present invention, the top surface of the cover closure 20 is provided with means for frictionally receiving the insert 28 in such a manner that it may be releaseably maintained and displayed upon the top of the cover section 14 when such is disposed in a closed box attitude and without the necessity of modifying either the insert 28 or other portions of the box construction other than the closure wall 20 above indicated. Such means includes the upstanding peripheral ridge 44 depicted in FIGS. 2 and 4 through 6.

Such ridge 44 may be integrally formed with the closure portion 20 of the cover section 14 as by vacuum forming techniques when the closure is formed of resinous plastics material, or other known techniques when formed of other known materials. It should be pointed out the peripheral extent of the ride 44 is generally equal to or slightly less than that of the ornament receiving surface 30 and of a similar geometric configuration so that the downwardly extending sidewalls 32 thereof will frictionally engage with inner portions of the ridge 44 and in this way assure retention of the insert 28 upon the top surface of the cover section 14 when said section is in closed attitude with its mating section 12. In addition to the use of the continuous upstanding ridge 44, discontinuous ridge portions (not shown) may be utilized. Also, a continuous groove (not shown) may be provided on the top surface of the cover section for frictional receipt of the terminal edges 36 of the sidewalls 32 to releasably mount the insert 28 on the cover section 14. Said groove may also be formed by vacuum forming or other conventional techniques. When such grooves are utilized and are of a significant depth, the ridge or ridge portions may be eliminated or, alternatively, displaced inwardly of the grooves so that the sidewalls 32 of the insert 28 are received therebetween.

Other attachment means may also be utilized so long as they effectively engage portions of the insert 28 in such a manner that the insert is releasably secured to the cover section of the box 10 in its closed attitude, and so that the insert may be readily removed therefrom when it is desired to again place the insert within the base section 12. It is thus apparent that the box construction of the present device may not only conventionally serve to display jewelry items and the like in a conventional mode, as in open disposition of the box sections, and also as a conventional container therefor, but may further serve in the novel manner heretofore described so as to display the jewelry with the box in closed position, thereby materially lessening the space requirements for such display.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A box for the display of jewelry and the like in alternative open and closed positions comprising, generally open face cover and base sections adapted for face to face disposition to each other in a closed position and hingedly connected to each other along a common line for spaced apart disposition in an open position, an insert having a generally planar surface for the receipt and display of said jewelry and the like and sidewalls downwardly extending from said display surface, said insert adapted for disposition within said base section of said box for containment therein and display in said open position, said cover section having a top surface, said top surface including means for temporarily frictionally positioning said insert sidewalls whereby said insert may be positioned on said top surface of said cover for alternative display of said jewelry and the like when said box is in its closed attitude.

2. The box construction of claim 1, said insert sidewalls downwardly extending from peripheral portions of said planar surface, independently movable from each other and outwardly upwardly biased towards said planar surface, said cover top surface means including upstanding ridge portions, said sidewalls positioned inwardly of said ridge portions so as to frictionally receive portions thereof and so as to restrain said sidewalls from said outward bias.

3. The box construction of claim 2, said ridge portions forming a substantially continuous ridge generally positioned at the periphery of said cover.

4. The box construction of claim 3, said cover top surface including a peripheral groove positioned adjacently inward of said ridge, said groove adapted for receipt of the terminal edges of said sidewalls.

5. The box construction of claim 1, said means for temporarily positioning said insert relative to the top surface of said cover including means for frictionally engaging portions of sidewalls downwardly extending from the periphery of said planar surface.

6. The box construction of claim 5, said means including a groove for receiving terminal peripheral edge portions of said sidewalls.

7. The box construction of claim 5, said means including an upstanding ridge for contacting outer surface portions of said sidewalls disposed inwardly thereof.

8. The box construction of claim 6, said means including an upstanding ridge disposed adjacent said groove and outwardly thereof.

9. The box construction of claim 5, said temporary positioning means disposed about said cover section top surface in a configuration similar to and generally of equal extent as the peripheral extent of said planar surface of said insert.

10. A display box for jewelry and the like comprising base and cover sections hingedly connected to each other for movement between open and closed position, an insert frictionally and removably mounted within said base section, fastening means associated with said insert for releaseably mounting thereon the article to be displayed, and means on the outer surface of said cover section for releaseably gripping and mounting said insert, whereby when desired said insert may be removed from said base section and mounted on the outside of said cover section so as to display said article with said box in its closed position.

* * * * *